US005690753A

United States Patent [19]

Kawauchi et al.

[11] Patent Number: 5,690,753

[45] Date of Patent: Nov. 25, 1997

[54] STEEL CONTAINING SUPER-FINELY DISPERSED OXIDE SYSTEM INCLUSIONS

[75] Inventors: Yuji Kawauchi, Muroran, Japan; Hirobumi Maede, deceased, late of Muroran, Japan, by Youko Maede, heiress

[73] Assignee: Nippon Steel Corporation, Tokyo, Japan

[21] Appl. No.: 416,845

[22] PCT Filed: Feb. 16, 1994

[86] PCT No.: PCT/JP94/00230

§ 371 Date: Apr. 14, 1995

§ 102(e) Date: Apr. 14, 1995

[87] PCT Pub. No.: WO95/05492

PCT Pub. Date: Feb. 23, 1995

[30] Foreign Application Priority Data

Aug. 16, 1993 [JP] Japan ..... 5-202416

[51] Int. Cl.[6] ..... C22C 38/06

[52] U.S. Cl. ..... 148/320; 420/8

[58] Field of Search ..... 148/320; 420/8

[56] References Cited

U.S. PATENT DOCUMENTS 5,234,513 8/1993 Inoue et al. ..... 420/94

5,391,241 2/1995 Watanabe et al. ..... 420/94

FOREIGN PATENT DOCUMENTS

| | | |
|---|---|---|
| 4-272119 | of 0000 | Japan . |
| 46-30935 | 9/1971 | Japan . |
| 50-51924 | 5/1975 | Japan . |
| 53-76916 | 7/1978 | Japan . |
| 55-10660 | 3/1980 | Japan . |
| 1-309919 | 12/1980 | Japan . |

OTHER PUBLICATIONS

126th, 127th Nishiyama Memorial Technology Lectures Report "Highly Clean Steels", pp. 11–15, published by Japan Steel Association in Nov., 1988 (translation of relevant portion).

*Primary Examiner*—Deborah Yee

*Attorney, Agent, or Firm*—Pollock, Vande Sande & Priddy

[57] ABSTRACT

A carbon steel containing super-finely dispersed oxide system inclusions, comprising, by weight, not more than 1.2% carbon, 0.01 to 0.10% Al, total oxygen of not more than 0.0050%, Mg which fulfills the relationship of the following formula:

$$(\text{total oxygen wt } \% \times 0.5) \leqq \text{total Mg wt } \% < (\text{total oxygen wt } \% \times 7.0)$$

and Mg oxides comprising $MgO \cdot Al_2O_3$ and free MgO.

3 Claims, No Drawings

STEEL CONTAINING SUPER-FINELY DISPERSED OXIDE SYSTEM INCLUSIONS

DESCRIPTION

1. Technical Field

The present invention relates to a steel containing super-finely dispersed oxide system inclusions, and provides a steel having superior properties which is not adversely affected by oxide system inclusions.

2. Background of the Invention

Recently, qualities required for steel materials have been gradually becoming more strict in their standards and more diversified, and there has been a strong demand for developing steels of more excellent properties. It has been known that oxide system inclusions in steel materials, especially alumina ($Al_2O_3$) system inclusions, cause wire materials such as tire cords to break, or deteriorate rolling-contact fatigue properties of bar steels such as bearing steels, or cause thin sheet steels used for cans to crack during pressing. Consequently, steels have been demanded which have small amounts of alumina system inclusions so as to lessen their adverse affects in steel materials, or which have alumina system inclusions improved in characteristics so as to become not harmful.

In the manufacture of steels with small amounts of alumina system inclusions, removal of alumina system inclusions of steels, attempts have been made to remove such inclusions which are generated in the refining process, as much as possible in the process. A summary of this trial is disclosed in the 126th, 127th Nishiyama Memorial Technology Lectures Report "Highly Clean Steels", pp. 11–15, published by Japan Steel Association in November, 1988, of which the technical abstract is attached (see Table 4 on p. 12). According to this document, technology for removal can be roughly classified into 1) a technique of decreasing alumina, which is a deoxidation product, in molten steel, 2) a technique of restraining or preventing generation of alumina due to oxidation in air or the like, and 3) a technique of decreasing alumina system inclusions introduced from refractories or the like. In the actual industrial process, alumina system inclusions are decreased by combining the above classified techniques appropriately with each other. Thus, the total oxygen (T.O.) amount as the measure of an amount of alumina system inclusions in molten steel can be lowered to the following level:

High carbon steel containing about 1 wt % carbon
T.O.: 5 to 7 ppm

Medium carbon steel containing about 0.5 wt % carbon
T.O.: 8 to 10 ppm

Low carbon steel containing about 0.1 wt % carbon
T.O.: 10 to 13 ppm

On the other hand, as stated above, it has been tried to improve alumina system inclusions in characteristics thereof so as to become not harmful, for example, by a method proposed by the present inventors which is described in JP patent application ser. No. 3-55556. According to the method, molten steel and flux are contacted with each other, the melting point of oxide system inclusions in the molten steel is made not higher than 1500° C., and a slab obtained from the molten steel is heated to 850° to 1350° C. and thereafter rolled. Thus, the inclusions are deformed into oblong shapes in a strict deformation rate-similar to that of the steel, and consequently, stress concentration on the inclusions is restrained, thereby preventing defects caused by inclusions in final products.

However, even if the above-described techniques for removing alumina system inclusions and eliminating their adverse affects are exercised, oxide system inclusions often cause defects in products. Therefore, this problem has been a significant technical obstacle. Meanwhile, it can be predicted that the level of oxide system inclusions required for steel materials will become more strict. There has been a strong desire for developing superior steels from which adverse affects of oxide system inclusions are completely eliminated.

DISCLOSURE OF INVENTION

The present invention is intended to solve the above problems and satisfy the current desires. It is an object of the invention to provide a superior steel from which adverse affects of oxide system inclusions are completely eliminated by a novel idea.

According to the invention, the following steel containing super-finely dispersed oxide system inclusions is provided:

A steel containing super-finely dispersed oxide system inclusions, comprising, by weight, not more than 1.2% carbon, 0.01 to 0.10% Al, total oxygen of not more than 0.0050%, and Mg of an amount which fulfills the relationship of the following formula (1):

$$(\text{Total oxygen wt }\% \times 0.5) \leqq \text{total Mg wt }\% < (\text{total oxygen wt }\% \times 7.0) \quad (1)$$

Also, there is provided the foregoing steel containing super-finely dispersed oxide system inclusions in which a rate of the number of oxide system inclusions fulfills the following formula (2):

$$(\text{Number of } MgO\cdot Al_2O_3 + \text{number of } MgO)/\text{number of total oxide system inclusions} \geqq 0.8 \quad (2)$$

The basic idea of the invention steel resides in that oxide system inclusions are dispersed in the steel as finely as possible so as to avoid adverse affects of the inclusions with respect to the quality of steel material. In other words, the larger the oxide system inclusions in the steel material are, the more liable they are to concentrate where stress is and to cause defects. Consequently, the inventors reached the idea of dispersing the inclusions minutely and finely. Thus, provided is a practical carbon steel containing Al with finely dispersed oxide system inclusions, to which an appropriate amount of Mg is added in accordance with the total oxygen (T.O.) amount. The principle of the idea is that the composition of oxide $Al_2O_3$ is subjected to transform into $MgO\cdot Al_2O_3$ or MgO by adding Mg so as to prevent aggregation of oxides and to disperse them finely. Since interfacial energy of $MgO\cdot Al_2O_3$ or MgO in contact with molten steel is smaller than that of $Al_2O_3$, aggregation of $MgO\cdot Al_2O_3$ and MgO is restrained so as to finely disperse.

Grounds for selecting a restricted amount of each of carbon and aluminum will be hereinafter described.

In the inventive steel, as described above, the oxide composition of $Al_2O_3$ is subjected to transform into $MgO\cdot Al_2O_3$ or MgO by addition of Mg. However, in a carbon steel containing more than 1.2 wt % C, Mg thus added generates a remarkable amount of carbides with carbon, so that $Al_2O_3$ can not be transformed into $MgO\cdot Al_2O_3$ or MgO, failing to achieve the object of the invention. Therefore, the carbon content is restricted to not more than 1.2 wt %.

On the other hand, Al is an essential component for controlling the size of crystal grains of the steel. When the Al content is less than 0.01 wt %, the crystal grains can not be made fully fine. If it exceeds 0.10 wt %, a further effect can not be expected.

Next, grounds for selecting a restricted amount of total oxygen (T.O.) will be described.

In the invention, the T.O. amount is the sum of an amount of soluted oxygen in the steel and an amount of oxygen which forms oxides (mainly, alumina), but the T.O. amount is substantially equal to the amount of oxygen which forms oxides. Therefore, the more T.O., the more the steel contains $Al_2O_3$ which must be improved. For this reason, the inventors studied the critical T.O. amount from which the effect of the invention can be expected. As a result, it was found that when the T.O. amount exceeds 0.0050 wt %, the amount of $Al_2O_3$ is too large, and the total amount of $Al_2O_3$ in the steel can not be transformed into $MgO \cdot Al_2O_3$ or MgO even if Mg is added, thereby alumina remains in the steel material. Consequently, the T.O. amount in the invention steel must be restricted to not more than 0.0050 wt %.

Grounds for selecting a restricted amount of Mg will be described below.

Mg is a strong deoxidizer, and is added so that it reacts with $Al_2O_3$ in the steel, deprives $Al_2O_3$ of oxygen and produces $MgO \cdot Al_2O_3$ or MgO. For this purpose, Mg of not less than a predetermined amount must be added in accordance with the amount of $Al_2O_3$, i.e., the T.O. wt %. Otherwise, unreacted $Al_2O_3$ remains. As a result of experiments in this relation, it was found that when the total Mg wt % is not less than "T.O. wt %×0.5", it is possible to avoid residual $Al_2O_3$ which has not reacted, and to fully transform the oxides into $MgO \cdot Al_2O_3$ or MgO. However, if the total Mg wt % exceeds "T.O. wt %×7.0", Mg carbide and Mg sulfide are formed, which is an unfavorable result in material quality. For the foregoing reasons, the optimum range of the Mg content is "T.O. wt %×0.5"≦Total Mg wt %<"T.O. wt %×7.0". The total Mg amount is the sum of soluble Mg, Mg from forming oxides, and Mg of forming other Mg compounds (unavoidably produced) in the steel.

Grounds for selecting a restricted rate of the number of oxide system inclusions will now be described.

In the refining process of steel, oxide system inclusions out of the range of the invention, i.e., oxide system inclusions other than $MgO \cdot Al_2O_3$ and MgO, exist due to unavoidable partial contamination. When the rate of the number of such oxide system inclusions is limited to less than 20% of the number of total oxide system inclusions, oxide system inclusions are finely dispersed with high reliability resulting in steel material which is improved in quality. Therefore, the following restriction has been made:

(The number of $MgO \cdot Al_2O_3$+the number of MgO)/the number of total oxide system inclusions≧0.8.

Although the basic idea of the invention is that an appropriate amount of Mg is added in accordance with the T.O. wt % of steel, Mg-containing steels have been already suggested in JP-B2-46-30935 and JP-B2-55-10660. The steel disclosed in JP-B2-46-30935 is a free cutting steel to which 0.0003 to 0.0060% Mg or Ba or both is added as an additive element for applying a free cutting property. The steel disclosed in JP-B2-55-10660 is a free cutting high-carbon high-chromium bearing alloy which includes 0.001 to 0.006% Ca, or 0.001 to 0.006% Ca and 0.0003 to 0.003% Mg.

Both of the suggestions relate to free cutting steels, and their object of adding Mg is application of the free cutting property is different from that of the invention. Consequently, these suggestions do not involve the technical idea of controlling an additive amount of Mg in accordance with the T.O. wt %, and they provide the steels which are quite different from the invention's steel.

The invention steel is not restricted to any particular manufacturing method. That is to say, melting of master steel may be carried out by either a blast furnace/converter process or an electric furnace process. Moreover, addition of elements to a molten master steel is not restricted to particular ways. Additive elements can be added to molten master steel in the form of the respective element metal or alloys thereof, and a charging way thereof can be freely selected from a supplying method of mere throwing in, a blowing method by inert gas, a method of supplying molten steel with an iron wire in which Mg source is filled, and so forth. Furthermore, process methods of manufacturing a steel ingot from molten master steel and rolling the steel ingot are not restricted to particular ways. Examples of the invention and comparative examples will be described below, and advantages of the invention will also be described.

EXAMPLE EXPERIMENT

Invention example 1

Molten pig iron discharged from a blast furnace was subjected to dephosphorization and desulfurization treatments. Subsequently, the molten pig iron was charged into a converter for oxygen blowing, thereby obtaining molten master steel having predetermined amounts of C (carbon), P (phosphorus) and S (sulfur). Al, Si, Mn and Cr were added into the molten master steel during discharging from the converter into a ladle and vacuum degassing. After the vacuum degassing process, a Mg alloy was added to the molten steel in the ladle containing the molten steel or a tundish for continuous casting or a mold for continuous casting. As to the Mg alloy, one or more of Si-Mg, Fe-Si-Mg, Fe-Mn-Mg, Fe-Si-Mn-Mg alloys each containing 0.5 to 30 wt % Mg, and an Al-Mg alloy containing 5 to 70 wt % Mg were used. Those Mg alloys were granular in size of not greater than 1.5 mm, and were added into the molten steel by the supplying method using iron wires in which the granular Mg alloys were filled or the method of injecting the granular Mg alloys with inert gas. Slabs were produced from the obtained molten steels by continuous casting. The slabs were rolled into spring wire materials (having a diameter of 10 mm ) which had chemical compositions shown in Table 1. Oxide system inclusions in the wire materials were only $MgO \cdot Al_2O_3$ or MgO, and they had a size of not more than 6μ in terms of a diameter of approximate circle, and were extremely fine. Further, the rotating bending fatigue test of the wire materials was carried out. As a result, fatigue lives of the invention Examples were longer than those of the comparative examples to which Mg was not added. Sizes of oxide system inclusions, compositions of inclusions which were confirmed, and the results of the rotating bending fatigue test are shown together in Table 1.

Comparative example 1

Spring wire materials shown in Table 1 were manufactured in substantially the same manner as in the invention example 1. In this case, however, three types of materials were produced by not adding Mg after vacuum degassing, by setting an additive amount of Mg (which was added by substantially the same method as the invention example) at not more than the lower limitation of the proper Mg wt % according to the invention, and by setting it at more than the upper limitation.

Inclusions of the spring wire materials thus obtained were investigated, and their rotating bending fatigue testing was performed. As shown in Table 1, the results were not as favorable as those of the invention example 1.

TABLE 1

| | | Chemical Composition of Wire Material (weight %) | | | | | | Additive Amount of Mg (with | Size and Composition | Rate of Number of | Rotating Bending Fatigue |
|---|---|---|---|---|---|---|---|---|---|---|---|
| | | C | Si | Mn | Al | O | Mg | regard to T.O.) | of Inclusions | Oxides | Life |
| Invention Example | 1 | 0.58 | 1.32 | 0.39 | 0.02 | 16 ppm | 58 ppm | Close to medium value T.Mg/ T.O. = 3.6 | 1.8 to 5 μ $Al_2O_3$.MgO MgO | 0.90 | 6.2 |
| | 2 | 0.58 | 1.34 | 0.38 | 0.02 | 15 ppm | 9 ppm | Close to lower limitation T.Mg/ T.O. = 0.6 | 1.9 to 5 μ $Al_2O_3$.MgO MgO | 0.86 | 6.0 |
| | 3 | 0.58 | 1.31 | 0.38 | 0.02 | 16 ppm | 107 ppm | Close to upper limitation T.Mg/ T.O. = 6.7 | 1.7 to 5 μ $Al_2O_3$.MgO MgO | 0.92 | 6.1 |
| | 4 | 0.58 | 1.33 | 0.39 | 0.02 | 15 ppm | 50 ppm | Close to medium value T.Mg/ T.O. = 3.3 | 1.8 to 6 μ $Al_2O_3$.MgO MgO $SiO_2$, CaO | 0.75 | 5.5 |
| Comparative Example | 1 | 0.58 | 1.34 | 0.38 | 0.02 | 14 ppm | tr | No Mg added | 5 to 18 μ $Al_2O_3$ | 0 | 1.0 |
| | 2 | 0.58 | 1.33 | 0.37 | 0.02 | 15 ppm | 6 ppm | Less than lower limitation Mg added T.Mg/ T.O. = 0.4 | 5 to 16 μ $Al_2O_3$ $Al_2O_3$.MgO | 0.70 | 1.3 |
| | 3 | 0.58 | 1.33 | 0.38 | 0.02 | 15 ppm | 116 ppm | Not less than upper limitation Mg added T.Mg/ T.O. = 7.7 | 3 to 15 μ $Al_2O_3$.MgO MgO MgO | 0.89 | 1.7 |

*Note 1: Both the invention examples and the comparative examples include the following chemical components: 0.010 to 0.012% P, 0.009 to 0.011% S, 0.07% Cr.
*Note 2: Concerning O and Mg, the total oxygen amount and the total Mg amount are shown.
*Note 3: The rate of the number of oxides = the number of ($Al_2O_3$.MgO + MgO)/the number of total oxides. The number of oxides which existed in 100 $mm^2$ was measured.
*Note 4: The rotating bending fatigue life is a relative value when a value of the comparative example 1 is 1.

Invention example 2

By substantially the same method as the invention example 1, molten Mg-containing steel including 0.06 to 0.07 wt % C was manufactured. By continuous casting, slabs were produced from the molten steel thus obtained. The slabs were rolled into thin steel sheets (having a width of 2000 mm and a thickness of 1.5 mm) which had compositions shown in Table 2. Oxide system inclusions in the steel sheets were only $MgO \cdot Al_2O_3$ or MgO, and they had a size of not more than 13μ in terms of a diameter of approximate circle, and were extremely fine. Further, these steel sheets were cold-rolled into 100 tons of thin steel sheets having a thickness of 0.5 mm, but cracking hardly occurred. Sizes of oxide system inclusions, compositions of inclusions which were confirmed, and states of cracking occurrence are shown together in Table 2.

Comparative example 2

Thin steel sheets shown in Table 2 were manufactured in substantially the same manner as the invention example 2. In this case, however, three types of sheets were produced by not adding Mg after the RH treatment, by setting an additive amount of Mg (which was added by substantially the same method as the invention example 2) at not more than the lower limitation of the proper Mg wt % according to the invention, and by setting it at more than the upper limitation. Results of investigation of inclusions of the thin steel sheets thus obtained and states of cracking occurrence are shown in Table 2. The results were not as favorable as those of the invention example 2.

TABLE 2

| | | Chemical Composition of Wire Material (weight %) | | | | | | Additive Amount of Mg (with | Size and Composition | Rate of Number of | Rotating Bending Fatigue |
|---|---|---|---|---|---|---|---|---|---|---|---|
| | | C | Si | Mn | Al | O | Mg | regard to T.O.) | of Inclusions | Oxides | Life |
| Invention Example | 1 | 0.06 | 0.24 | 0.38 | 0.03 | 20 ppm | 70 ppm | Close to medium value T.Mg/ T.O. = 3. 5 | 3 to 10 μ $Al_2O_3$.MgO MgO | 0.90 | 0 |
| | 2 | 0.07 | 0.23 | 0.40 | 0.03 | 21 ppm | 13 ppm | Close to lower limitation T.Mg/ T.O. = 0.6 | 3 to 10 μ $Al_2O_3$.MgO MgO | 0.88 | 0 |
| | 3 | 0.06 | 0.25 | 0.38 | 0.03 | 20 ppm | 134 ppm | Close to upper limitation T.Mg/ T.O. = 6.7 | 2 to 10 μ $Al_2O_3$.MgO MgO | 0.93 | 0 |
| | 4 | 0.07 | 0.24 | 0.40 | 0.03 | 21 ppm | 63 ppm | Close to medium value T.Mg/ T.O. = 3.3 | 3 to 13 μ $Al_2O_3$.MgO MgO $SiO_2$, CaO | 0.69 | 17 |

TABLE 2-continued

| | | Chemical Composition of Wire Material (weight %) | | | | | | Additive Amount of Mg (with | Size and Composition | Rate of Number of | Rotating Bending Fatigue |
|---|---|---|---|---|---|---|---|---|---|---|---|
| | | C | Si | Mn | Al | O | Mg | regard to T.O.) | of Inclusions | Oxides | Life |
| Comparative Example | 1 | 0.07 | 0.23 | 0.39 | 0.03 | 20 ppm | tr | No Mg added | 10 to 25 μ $Al_2O_3$ | 0 | 135 |
| | 2 | 0.06 | 0.24 | 0.38 | 0.02 | 20 ppm | 4 ppm | Less than lower limitation Mg added T.Mg/ T.O. = 0.2 | 8 to 23 μ $Al_2O_3$ $Al_2O_3$.MgO | 0.73 | 102 |
| | 3 | 0.06 | 0.25 | 0.38 | 0.03 | 22 ppm | 172 ppm | Not less than upper limitation Mg added T.Mg/ T.O. = 7.8 | 5 to 20 μ $Al_2O_3$.MgO MgO MgO | 0.85 | 68 |

*Note 1: Both the invention examples and the comparative examples include the following chemical components: 0.007 to 0.010% P, 0.005 to 0.006% S.
*Note 2: Concerning O and Mg, the total oxygen amount and the total Mg amount are shown.
*Note 3: The rate of the number of oxides = the number of ($Al_2O_3$.MgO + MgO)/the number of total oxides. The number of oxides which existed in 100 $mm^2$ was measured.
*Note 4: The cracking occurrence is the number of occurrences per 1000 ton of cold rolling.

Invention example 3

By substantially the same method as the invention example 1, molten Mg-containing steel including 0.98 to 1.01 wt % C was manufactured. By continuous casting, slabs were produced from the molten steel thus obtained. The slabs were rolled into steel bars, and bearing steels (having a diameter of 65 mm) which had compositions shown in Table 3 were produced. Oxide system inclusions in the steel materials were only $MgO \cdot Al_2O_3$ or MgO, and they had a size of not greater than 4.0μ in terms of a diameter of approximate circle, and were extremely fine. Further, when rolling-contact fatigue testing of these steel materials was performed, favorable results shown in Table 3 were obtained. Sizes of oxide system inclusions, and compositions of inclusions which were confirmed are shown together in Table 3.

Comparative example 3

Bearing steels shown in Table 3 were manufactured in substantially the same manner as the invention example 3. In this case, however, three types of steels were produced by not adding Mg after the RH treatment, by setting an additive amount of Mg (which was added by substantially the same method as the invention example 3) at not more than the lower limitation of the proper Mg wt % according to the invention, and by setting it at more than the upper limitation. Sizes and compositions of inclusions of the bearing steels thus obtained and results of the rolling-contact fatigue testing are shown in Table 3. The results were not as favorable as those of the invention example 3.

TABLE 3

| | | Chemical Composition of Wire Material (weight %) | | | | | | Additive Amount of Mg (with | Size and Composition | Rate of Number of | Rotating Bending Fatigue |
|---|---|---|---|---|---|---|---|---|---|---|---|
| | | C | Si | Mn | Al | O | Mg | regard to T.O.) | of Inclusions | Oxides | Life |
| Invention Example | 1 | 1.01 | 0.28 | 0.85 | 0.02 | 7 ppm | 24 ppm | Close to medium value T.Mg/ T.O. = 3.4 | 0.5 to 3.5 μ $Al_2O_3$.MgO MgO | 0.90 | 6.6 |
| | 2 | 1.00 | 0.27 | 0.87 | 0.02 | 7 ppm | 4 ppm | Close to lower limitation T.Mg/ T.O. = 0.6 | 0.5 to 3.8 μ $Al_2O_{3.MgO}$ MgO | 0.98 | 6.3 |
| | 3 | 0.99 | 0.26 | 0.85 | 0.02 | 7 ppm | 48 ppm | Close to upper limitation T.Mg/ T.O. = 6.8 | 0.5 to 3.7 μ $Al_2O_3$.MgO MgO | 0.98 | 6.5 |
| | 4 | 1.00 | 0.29 | 0.88 | 0.02 | 7 ppm | 23 ppm | Close to medium value T.Mg/ T.O. = 3.3 | 0.5 to 4 μ $Al_2O_3$.MgO MgO $SiO_2$, CaO | 0.71 | 5.5 |
| Comparative Example | 1 | 1.00 | 0.28 | 0.87 | 0.02 | 7 ppm | tr | No Mg added | 5 to 15 μ $Al_2O_3$ | 0 | 1.0 |
| | 2 | 1.00 | 0.26 | 0.84 | 0.02 | 7 ppm | 2 ppm | Less than lower limitation Mg added T.Mg/ T.O. = 0.3 | 4 to 13 μ $Al_2O_3$ $Al_2O_3$.MgO | 0.67 | 1.2 |

TABLE 3-continued

| | Chemical Composition of Wire Material (weight %) | | | | | | Additive Amount of Mg (with | Size and Composition | Rate of Number of | Rotating Bending Fatigue |
|---|---|---|---|---|---|---|---|---|---|---|
| | C | Si | Mn | Al | O | Mg | regard to T.O.) | of Inclusions | Oxides | Life |
| 3 | 1.02 | 0.27 | 0.86 | 0.02 | 7 ppm | 51 ppm | Not less than upper limitation Mg added T.Mg/T.O. = 7.3 | 3 to 12 μ $Al_2O_3$.MgO MgO MgO | 0.85 | 1.6 |

*Note 1: Both the invention examples and the comparative examples include the following chemical components: 0.007 to 0.010% P, 0.005 to 0.006% S, 1.07 to 1.10% Cr.
*Note 2: Concerning O and Mg, the total oxygen amount and the total Mg amount are shown.
*Note 3: The rate of the number of oxides = the number of ($Al_2O_3$.MgO + MgO)/the number of total oxides. The number of oxides which existed in 100 $mm^2$ was measured.
*Note 4: The result of rolling-contact fatigue testing is a relative value when a value of the comparative example 1 is 1.

According to the present invention, as has been described in detail heretofore, the oxide system inclusions $Al_2O_3$ in the steel are transformed into $MgO \cdot Al_2O_3$ or MgO, and the rate of the number of unavoidably introduced oxide system inclusions is restricted, so that the size of the oxide system inclusions in the steel can be decreased to the level which has never been attained by the prior art. Thus, it becomes possible to provide superior steel materials from which unfavorable influences of $Al_2O_3$ system inclusions are eliminated. This effect is quite significant to the industry.

Industrial Applicability

The invention steel in which oxide system inclusions are finely dispersed can be used as a superior structural material because the inclusions which may unfavorably influence mechanical strength of ordinary steel are improved not to have such influences.

We claim:

1. A carbon steel containing super-finely dispersed oxide system inclusions, comprising, by weight, not more than 1.2% carbon, 0.01 to 0.10% Al, total oxygen of not more than 0.0050%, Mg which fulfills the relationship of the following formula:

$$(\text{total oxygen wt } \% \times 0.5) \leqq \text{total Mg wt } \% < (\text{total oxygen wt } \% \times 7.0)$$

and Mg oxides containing $MgO \cdot Al_2O_3$ and free MgO.

2. A carbon steel containing super-finely dispersed oxide system inclusions according to claim 1, wherein a rate of the number of particles of oxide system inclusions fulfills the following formula:

$$(\text{particle number of } MgO \cdot Al_2O_3 + \text{particle number of free MgO}) / \text{particle number of total oxide inclusions} \geqq 0.8.$$

3. A carbon steel containing super-finely dispersed oxide system inclusions according to claim 1, comprising, by weight, at least 0.06% carbon.

* * * * *